US009498042B2

(12) United States Patent
Villarreal et al.

(10) Patent No.: US 9,498,042 B2
(45) Date of Patent: Nov. 22, 2016

(54) DISPENSER WITH SPACED THERMAL MEMBER

(71) Applicant: HCT Group Holdings Limited, Central (HK)

(72) Inventors: Armando Villarreal, Los Angeles, CA (US); Timothy Thorpe, Santa Monica, CA (US); Adrian C. Apodaca, Daly City, CA (US)

(73) Assignee: HCT Group Holdings Limited, Central (HK)

( * ) Notice: Subject to any disclaimer, the term of this patent is extended or adjusted under 35 U.S.C. 154(b) by 0 days.

(21) Appl. No.: 14/313,601

(22) Filed: Jun. 24, 2014

(65) Prior Publication Data

US 2014/0376985 A1 Dec. 25, 2014

Related U.S. Application Data

(60) Provisional application No. 61/838,819, filed on Jun. 24, 2013.

(51) Int. Cl.
*A45D 34/04* (2006.01)
*A45D 34/00* (2006.01)

(52) U.S. Cl.
CPC ..... *A45D 34/04* (2013.01); *A45D 34/041* (2013.01); *A45D 2034/002* (2013.01); *A45D 2200/155* (2013.01)

(58) Field of Classification Search
CPC ..... A45D 34/041
USPC ..... 401/1, 2
See application file for complete search history.

(56) References Cited

U.S. PATENT DOCUMENTS

| | | | | |
|---|---|---|---|---|
| 7,955,016 | B2 * | 6/2011 | Gueret | 401/125 |
| 2008/0279616 | A1 * | 11/2008 | Thorpe | 401/265 |
| 2011/0103878 | A1 * | 5/2011 | Neuner et al. | 401/203 |
| 2013/0223913 | A1 * | 8/2013 | Duru | 401/2 |
| 2014/0234004 | A1 * | 8/2014 | Thorpe et al. | 401/1 |

FOREIGN PATENT DOCUMENTS

| | | | |
|---|---|---|---|
| FR | 2964307 | A1 | 3/2012 |
| GB | 2449141 | A | 11/2008 |
| WO | 2012025691 | A1 | 3/2012 |
| WO | 2013/017801 | A1 | 2/2013 |

OTHER PUBLICATIONS

International Search Report mailed Aug. 26, 2014 in corresponding International Application No. PCT/US2014/043883.

* cited by examiner

*Primary Examiner* — Mark A Laurenzi
*Assistant Examiner* — Joshua Wiljanen
(74) *Attorney, Agent, or Firm* — Seager, Tufte & Wickhem LLP

(57) ABSTRACT

A dispenser includes a housing having a reservoir for containing a product. An applicator tip is coupled to the housing and has an applicator and a product delivery passageway extending through the applicator tip and terminating at an opening in the applicator. A thermal storage mechanism is disposed on the applicator spaced from the opening in the applicator and provides an application surface for contacting a user.

18 Claims, 4 Drawing Sheets

DISPENSER WITH SPACED THERMAL MEMBER

CROSS REFERENCE TO RELATED APPLICATIONS

This application claims priority to U.S. Provisional Patent Application No. 61/838,819, filed on Jun. 24, 2013, which is hereby incorporated by reference in its entirety herein.

BACKGROUND

Devices for dispensing cosmetics and medicinal products are known. One conventional configuration includes an outer tubular shell or housing having a reservoir containing a product and an applicator tip disposed on a distal end of the shell or housing. In the medical industry, applicators are used for applying products such as ointments to portions of the body. In the cosmetic and personal care industries, applicators may be used to apply lipstick, lip balm, creams, and lotions to portions of a user's body.

In many cases, the medicinal and cosmetic products include skincare substances, such as aloe or lanolin, that provide a healing or therapeutic effect to heal damaged skin or to maintain healthy skin. In addition, these products may include therapeutic substances, such as topical anesthetics, analgesics, fragrances, or menthol.

Conventional application of conventional products to the skin is sufficient in many instances, but in some instances it also is desirable to provide a thermal treatment to the skin contemporaneously with application of the product. For example, it may be desirable to apply a cooling or heating sensation via the applicator. In some instances, it may be desirable to have the applicator provide either a heating or cooling sensation, which may offset or enhance a thermal sensation from the product or be completely independent of the product.

SUMMARY

This summary is provided to introduce simplified concepts of applicator tips with thermal members, which are further described below in the Detailed Description. This summary is not intended to identify essential features of the claimed subject matter, nor is it intended for use in determining the scope of the claimed subject matter.

This disclosure describes an improved tip, such as for a cosmetic applicator, that includes a thermal member that is capable of storing and retaining thermal energy. The improved tips according to this disclosure are generally useful to allow a product to be applied locally or topically to a selected area of a user's skin, while providing a thermal effect.

In one implementation, a cosmetic applicator includes an applicator tip having an opening therein through which a cosmetic product is dispensed, and a thermal member disposed on the tip, spaced from the opening.

In some implementations, the thermal member is configured as a plate disposed on an applicator tip. The plate may provide an application face for applying product dispensed from the applicator tip to the user's skin.

In still further implementations, a dispenser includes a housing having a reservoir for containing a product. An applicator tip is coupled to the housing and has an applicator face and a product delivery passageway extending through the applicator tip and terminating at an opening in the applicator face. A thermal member is disposed on the applicator face, spaced from the opening.

In some implementations, a product delivery passageway extending through the applicator tip is offset from a central axis of the applicator tip.

A better understanding of these and other implementations will be better understood with reference to the attached Figures and the following Detailed Description, in which features of this disclosure are illustrated and described.

BRIEF DESCRIPTION OF THE DRAWINGS

The figures are described in more detail below in the Detailed Description section of this application. In the figures, the left-most digit of a reference number identifies the figure in which the reference number first appears. The use of the same reference numbers in different figures indicates similar or identical items.

DETAILED DESCRIPTION

Figure 1:
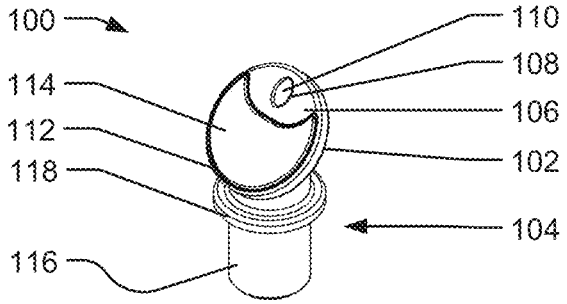
FIG. 1 is a perspective view of an illustrative applicator tip according to one implementation.

In one implementation, a product is dispensed from a reservoir in the container through one or more openings in the dispenser tip for application to a user's skin. The tip application surface contacts the user's skin during or after dispensing of the product, and the user may cause the application face to contact an even larger area of skin, for example, when the user causes the application face to spread the product on his/her skin. By virtue of the thermal member's thermal retention, thermal energy is applied to the user's skin for heating or cooling during application. Contact of the thermal member with the product may also result in transfer of heat to or from the product. Accordingly, in some embodiments the user will feel a thermal sensation (warm or cool depending on the thermal energy in the thermal member), in other embodiments the product will be warmed or cooled, and in still other embodiments both the product and user's skin will be thermally effected by the thermal member.

The thermal member includes a material capable of retaining and transferring heat or cold for a period of time. Accordingly, in some embodiments, the thermal member may be made in whole or in part of a material having a thermal conductivity above a threshold. For instance, in some embodiments, to retain and transfer sufficient heat or cold the thermal member may be made of a material having a thermal conductivity of at least 1 watt/meter-kelvin. In other implementations, thermal conductivities greater than about 5.0 watt/meter-kelvin are desirable and, in still further implementations, thermal conductivities greater than about 20.0 watt/meter-kelvin are desirable.

Other material properties may also describe aspects of thermal members. For instance, heat capacity of the material may also be relevant. In some embodiments, the material from which the thermal member is made in whole or in part may also have a heat capacity of at most about 1.1 kilojoules/kilogram-kelvin. In other instances, heat capacities lower than about 0.75 J/kg-K may be desirable. Moreover, thermal effusivity, which factors in a material's thermal conductivity, heat capacity, and density may be of interest. Generally, the higher the effusivity, the greater will be the heat transfer to or from the user's skin. In some embodiments, materials having a thermal effusivity higher than about 150.0 $J\text{-}m^{-2}\text{-}K^{-1}\text{-}s^{-1/2}$ may be preferred.

In some embodiments, the heat or cold retained (for subsequent transfer) by the thermal member results from exposure to the ambient environment. That is, in some embodiments, after transfer of the heat or cold from the thermal member to the user's skin, the thermal member regenerates, i.e., reheats or re-cools, merely by being exposed to the ambient environment. For the purpose of this application, the term ambient environment refers to a comfortable indoor room temperature of between about 20° C. (68° F.) and about 25° C. (77° F.). In these embodiments and under the noted conditions, no additional heating or cooling may be required. In other embodiments, it may be desirable to introduce the thermal member to a higher or lower temperature than ambient to "charge" the thermal member with the desired heat/cold.

In implementations of this disclosure, the thermal member may include one or more of metal, stone material, and ceramic, or composites thereof, whether natural or synthetic, capable of retaining and transferring heat or cold for a period of time.

Some example metals that may be used in embodiments of this disclosure include, without limitation, stainless steel, aluminum, zinc, magnesium, tin, nickel, titanium, steel, tin, copper, brass, platinum, gold, and silver, and alloys, such as ZAMAK.

Stone materials that may be used in embodiments of this disclosure include, without limitation, any stone, rock, mineral, ore, gemstone, imitation gemstone, glass stone (including naturally occurring and man-made forms of glass), volcanic stone, coral stone, metallic stone or ore, magnetic stone, concrete, or composites thereof, whether synthetic or naturally occurring.

Figure 2:
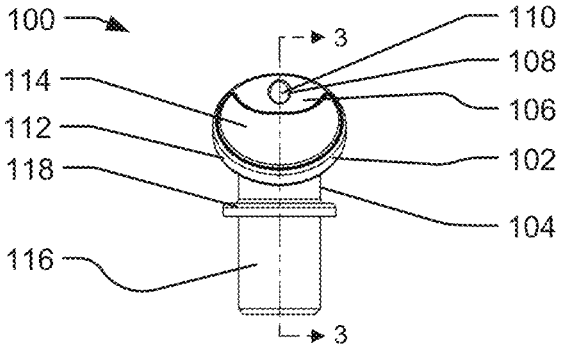
FIG. 2 is a front view of the applicator tip illustrated in FIG. 1.
Figure 3:
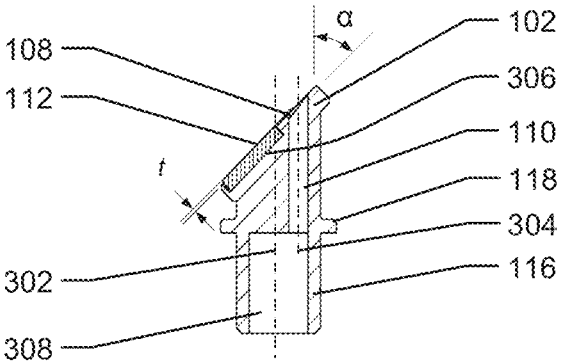
FIG. 3 is a cross-sectional view of the applicator tip illustrated in FIG. 1, taken along section line 3-3 in FIG. 2.

FIGS. 1-3 illustrate a dispenser tip 100 according to a first implementation. The tip 100 generally includes an applicator 102 disposed on a body 104. In the illustrated implementation, the applicator 102 is generally disc-shaped and the body 104 is substantially cylindrical. In other implementations, the applicator 102 and/or the body 104 may take any shape. The applicator 102 has a face 106, which, in the illustrated embodiment, is generally circular (because of the disc-shape of the applicator 102). An opening 108 is formed in the applicator face 106. Product dispensed through the tip 100 via a product delivery passageway 110 exits through the opening 108.

A thermal member 112 is disposed on the face 106 of the applicator 102. The thermal member 112 is spaced from the opening 108 in the face 106 of the applicator 102. In this manner, product dispensed through the opening 108 via the product delivery passageway 110 does not contact the thermal member 112 during dispensing (or at any time before use). In FIG. 1, the thermal member 112 comprises a crescent-shaped plate, but may take any suitable shape.

The Figures illustrate a plate of a certain shape, but this disclosure is not limited to that shape. In some implementations, the shape preferably provides a relatively large continuous application face 114 that is spaced from the opening 108. Any number of shapes and sizes can provide this functionality. Moreover, although the plate is illustrated as generally having a planar application face 114, such is also not required. The application face may include planar, convex, and/or concave surface features. Moreover, a portion or all of the application face 114 may be textured. As will be appreciated from this disclosure, the application face 114 is generally intended to contact the user's skin and the application face 116 may include any shape or feature that may provide a desirable feel to a user. In addition, in the illustrated embodiments, the thermal member 112 is continuous, i.e., it has no apertures, but this is not required. It may include apertures, such as holes or slots and those apertures may be located on any face of the application, e.g., front, side, back, either near to or far from the thermal member. Moreover, the application face 114 may be made up of several smaller thermal members, which may be spaced from each other, and some or all of which may be spaced from the opening 108.

The thermal member 112 may be made from any number of materials capable of holding a thermal charge. In some implementations, each of the members 112 may be made of any one of the materials described herein above. In the implementations illustrated in FIGS. 1-4, the thermal member 112 includes a contiguous plate having a substantially uniform composition. Such plates may be readily manufactured using known methods, such as stamping, molding, sintering, or machining. In other implementations, the thermal member 112 may have a plurality of different compositions, which may be joined to form a relatively larger contiguous plate, such as the one illustrated as the thermal member 112. Alternatively, as in the embodiment of FIG. 6B described below, for example, the thermal member may be provided as a plurality of separate contiguous plates, to be affixed or otherwise disposed on the applicator either spaced or abutting.

As noted above, the thermal member may be embodied in any of a number of shapes, sizes, and compositions. In some embodiments, the thermal member may have a mass of at least about 0.1 grams to at most about 5.0 grams. In other embodiments, the mass is at least about 0.50 grams to at most about 2.0 grams. In one embodiment, each thermal member has a mass of about 0.75 grams. Also, in some embodiments, the thermal members may have a size of from at least about 25 to at most about 500 $mm^3$. Volumes of at least about 75 $mm^3$ to at most about 100 $mm^3$ may be used in some implementations. However, in other implementations, the thermal members may have a mass and/or volume greater than or less than the ranges listed. As will be understood, several of the size and weight measurements will be dictated by the material chosen as the thermal member, and the area available on the applicator tip 100 to retain the thermal member.

In one implementation, the thermal member 112 is applied directly on the face 106 of the applicator 102 using known methods. For example, the thermal member 112 may be adhered, welded, or otherwise fastened to the face 106. In another implementation, which is best illustrated in FIG. 3, the thermal member 112 is retained in a recess 306 formed in the face 106. As illustrated in FIG. 3, the depth of the recess is slightly less than the thickness of the plate-shaped member, such that the application face 114 of the thermal member 112 is offset a distance t relative to the face 106 of the applicator 102. This offset t may be useful to ensure that the application face 114 of the thermal member 112 protrudes from the face 106 and contacts the user's skin when the tip 100 is pressed against the skin, i.e., not the face 106 of the applicator. In other implementations, the recess 306 may be deeper such that the application face 114 of the thermal member 112 is flush with or sunken relative to the face 106 of the applicator 102. As should be appreciated, the depth of the recess 306 may be varied to provide any desired offset of the application face 114 relative to the face 106 of the applicator 102, even a zero offset.

The thermal member 112 may be retained in the recess 304 in any number of ways. For example, the recess may be configured to accept the thermal member 112 with a clearance fit, with the thermal member being retained therein using a conventional fastening means, for example an adhesive or spot welding. In still other implementations, the recess 304 is sized to provide an interference fit with the thermal member 112. In such implementations, the thermal member is pressed into the recess. The interference between the member 112 and the recess 304 may be sufficient to retain the thermal member in the applicator tip, although in some implementations, another fastening means may be used in addition to the interference fit. In another implementation, the recess 304 and the member 112 may be sized such that the member 112 is retained in the recess 304 by a snap fit. With the benefit of this disclosure, those having ordinary skill in the art will appreciate other configurations that result in retention of the thermal member in the recess 304.

Several advantages are realized by forming the thermal member 112 separate from the remainder of the applicator tip 100. For instance, conventional machining and manufacturing processes can be used. In example implementations, the thermal member 112 can be formed using a stamping process or conventional cutting or milling techniques. Moreover, when the thermal member 112 is disposed in the recess 304, the thermal member may require less machining than when it is disposed directly on the face 106 of the applicator 102. Specifically, a portion of the thermal member 112 is effectively buried in the recess 304, and the buried portion need not be finished, because it will not contact the user.

In the implementation illustrated in FIGS. 1-3, the opening 108 in the face 106 of the applicator 102 is offset relative to the center of the tip 100. As shown best in FIG. 3, the product delivery passageway 110 provides a conduit to the opening 108 from a tip reservoir 308, which is a volume defined by the neck 116. In the illustration, the product delivery passageway is a generally cylindrical passageway having an axis 304 that is parallel to, but offset from, a central axis 302 of the dispenser tip 100. Offsetting the opening 108 on the face 106 provides for a larger contiguous surface area, i.e., a larger solid surface area not interrupted by the opening, on a side of the opening 108 than would be achieved by placing the opening directly in the center of the face. In this manner, a larger thermal member that does not entirely or substantially circumscribe the opening 108 may be used.

Although it is beneficial in some instances to offset the opening relative to the tip axis 302, it is not required. In other embodiments, the product delivery passageway axis 304 may be coaxial with the tip axis 302. Moreover, although an axial product delivery passageway is generally easiest to create from a manufacturing standpoint, the product delivery passageway may take any shape or form so long as it provides an effective conduit to dispense the product through the opening 108. Likewise, the opening 108 may take any shape or form and may be the same or different shape than the product delivery passageway.

Other modifications also are contemplated. For example, in the embodiments of FIGS. 1-3, the applicator 102 is angled relative to the body 104. That is, the face 106 of the disc-shaped applicator 102 is angled relative to an axis of the cylindrical body 104 by an angle $\alpha$, as shown in FIG. 3. In other implementations, the applicator 102 may not be angled relative to the body 104, i.e., $\alpha=0$, or the angle may vary from what is illustrated (e.g., it may be any angle from 0-180°).

Figure 4:
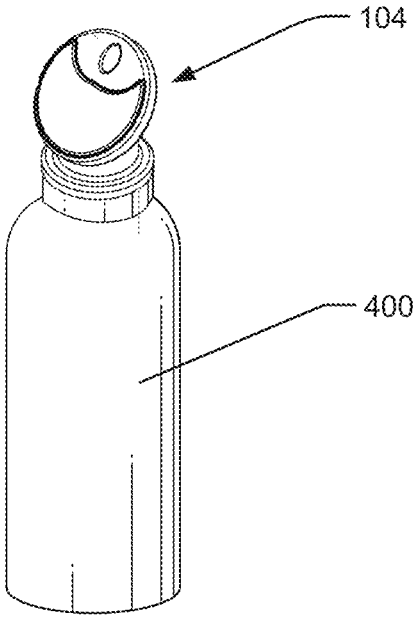
FIG. 4 is a perspective view of an applicator tip according to an alternative implementation.

In FIGS. 1-3, the dispenser tip 100 is generally illustrated as including a flange 118 formed on a neck 116. In this implementation, the neck 116 facilitates attachment of the dispenser tip 100 to a container 400, an example of which is shown in FIG. 4. The container 400 has a mating receptacle configured to receive the neck 116. The flange 118 acts as a stop to prevent further insertion of the dispenser tip 100 into the container. The dispenser tip 100 is thereafter affixed to the container using conventional methods. For example, the neck 116 may consist of a relatively soft plastic that, when heated, will bond to material comprising the container. In other implementations, the neck 116 may be slightly larger than the mating receptacle in the container 400, to create a friction fit between the neck and the container 400.

Figure 5A:
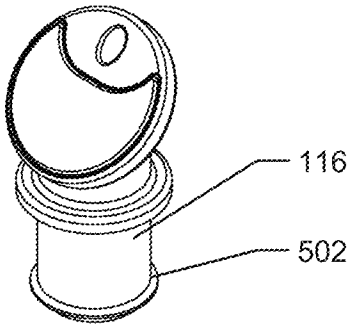
FIGS. 5A-5C are perspective views of applicator tips according to alternative implementations.
Figure 5B:
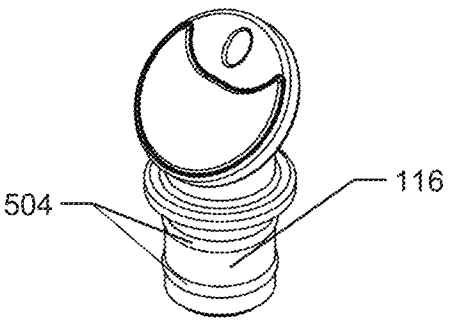
Figure 5C:
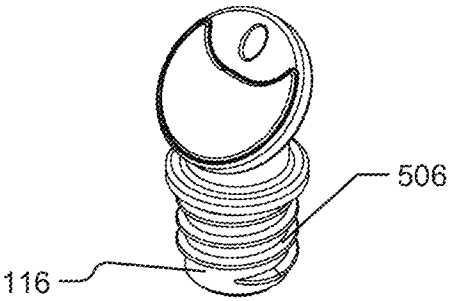

The neck 116 arrangement of FIGS. 1-3 is generally shown as a generic implementation; the invention is not limited to that implementation. FIGS. 5A-5C show alternative implementations in which the neck 116 includes additional features to facilitate attachment of the dispenser tip 100 to a container containing a product to be dispensed through the dispenser tip 100.

In FIG. 5A, the neck 116 includes an annular ring 502 disposed proximate its distal end. The annular ring 502 is provided to create a snap fit with the container to which the dispenser tip is to be connected. Although not illustrated, the container preferably has a mating recess or otherwise stepped profile into which the protruding annular ring 502 passes upon insertion of the dispenser tip into the container. Upon insertion, the annular ring is retained by the stepped or recessed profile in the container to prevent ready removal of the dispenser tip 100 from the container. The flange 118 is also illustrated in the embodiment of FIG. 5A, again to prevent over-insertion of the applicator tip into the container, although those having ordinary skill in the art will appreciate that the flange may not be required, particularly depending upon the corresponding feature in the container. As with any of the implementations described in this disclosure, additional fastening means may also be employed. For example, an adhesive or the like may be disposed on the neck 116 to further aid in retaining the tip 100 in the container.

In FIG. 5B, the neck 116 includes a plurality of annular protrusions 504 or ribs spaced from each other. The annular protrusions 504 are similar to the annular ring 502 of FIG. 5A, but are spaced along the neck 116. Like in the embodiment of FIG. 5A, the tip of FIG. 5B is intended to be inserted into an opening in a container. Although not illustrated, the container opening is preferably sized to have a clearance fit relative to the outer diameter of the neck 116, but the annular protrusions 504 increase the outer diameter of the neck 116 at their locations. The annular protrusions 504 preferably provide an interference or friction fit with the inner diameter of the container opening. In one implementation, the friction fit between the annular protrusions 504 and the inner diameter of the container is sufficient to retain the dispenser tip 100 in the container. In other implementations, additional fastening means, such as adhesives, may be used to further affix the dispenser tip in the container.

FIG. 5C illustrates yet another method for retaining the dispenser tip 100 in a container containing a product to be dispensed through the dispensing tip 100. As illustrated, a thread 506 is disposed on the outer surface of the neck 116.

This dispensing tip 100 is intended to be used with a container having a mating threaded opening, such that the dispenser tip 100 is threaded into the opening of the container. Although a single, continuous thread is illustrated in FIG. 5C, the invention is not limited to one thread. Nor is it limited to a continuous thread. Moreover, as with other embodiments described in this disclosure, an adhesive or like may be used in connection with the thread 506 to aid in retention of the dispenser tip 100 in the container.

Other features may also be used to aid in retention of the dispenser tip 100 in a container. For example, in the embodiments illustrated in FIGS. 5A and 5B, the dispenser tip 100 may be free to rotate relative to the container, even when the dispenser tip 100 is retained in the container. To prevent this rotation, a key or similar feature may also be provided, either on the neck 116 or for use in cooperation with the neck 116.

Figure 6B:
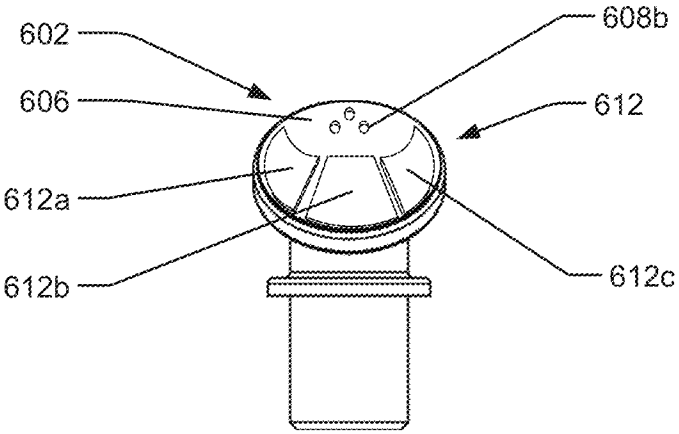
FIGS. 6A and 6B are front views of applicator tips according to still further alternative implementations.
Figure 6A:
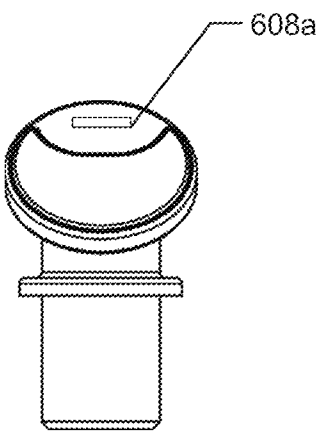

Additional implementations of the dispenser tip 100 are illustrated in FIGS. 6A and 6B. In those figures, the opening 108 is modified. Specifically, FIG. 6A shows a rectangular opening 608*a* instead of the circular opening 108. In FIG. 6B, the circular opening 108 is replaced with a plurality of smaller holes 608*b*. Although those holes are illustrated as being circular, they may be any shape without departing from the spirit and scope of this disclosure. Those having ordinary skill in the art will appreciate that varying the size and shape of the opening 108 will result in different application amounts and/or profiles, which may be useful in applying different products. The varying openings 108, 608*a*, 608*b* may be to help spread or distribute the product, or for aesthetic purposes. In other implementations, the opening(s) may be further designed to take the shape of a logo or other identifying mark associated with the provider of the product dispensed through the dispensing tip. For example, the opening may take the shape of a number or letter.

In still further implementations, the size and shape of the opening may cooperate with the size and shape of the thermal member 112 to provide an overall aesthetic of the dispenser tip. For example, the opening may be shaped as a portion of a logo whereas the thermal member is shaped as a separate or additional portion of the same logo, to provide the overall aesthetic. Such an arrangement may be more readily achievable according to embodiments of this disclosure, because the thermal member 112 is formed separately from the remainder of the dispenser tip 100 in some implementations.

FIG. 6B also illustrates a modified thermal member 612. As with the thermal member 112 described above with respect to FIGS. 1-3, the thermal member 612 is disposed on a face 606 of an applicator 602. In this embodiment, though, the thermal member 612 includes three smaller thermal members 612*a*, 612*b*, 612*c*, each differently shaped. Although the smaller thermal members 612*a*, 612*b*, 612*c* are illustrated as spaced relative to each other, they may abut. Depending upon the application, some or all of the smaller thermal members 612*a*, 612*b*, 612*c* may have different compositions and/or they may have different surface features, e.g., coloring, texturing, profiling. Such varied characteristics may add to the functionality and/or to the aesthetic.

In some implementations, this disclosure provides advantages over previous dispenser tip arrangements. For example, the thermal member is not in contact with any of the product delivery passageway 110. In this manner, the product is applied to the user unaffected by the thermal member. Because the thermal member is not in constant contact with the product, product/thermal member combinations that were previously not achievable, for example, because one or both of the product and the thermal member may degrade, e.g., rust, when there is constant contact between the thermal member and the product, are now attainable. Another advantage over other previous dispenser tip arrangements is that the thermal member may be formed separately from the tip, allowing for greater design and manufacturing freedoms. For example, the thermal member may be formed in any number of shapes and sizes. Also, conventional techniques may be employed to form the tip and to form the thermal member. In the implementation of FIGS. 1-3, for example, the tip is formed as a unitary piece, which may be accomplished using a conventional technique such as injection molding. Moreover, because the tips may be made independently of the thermal members, they can be created in bulk and stored for later attachment of the thermal member. Thermal storage members having different compositions may thus be used with a single tip design. A still further advantage over previous dispenser tip arrangements is that the separate thermal member may have a larger size, while still providing a uniform composition.

The tip 100 need not be formed as a unitary piece. It may be formed as separate parts and thereafter assembled. For example, it may be desirable to form certain portions of the tip 100 from different materials. By way of non-limiting example, the neck may comprise a softer, more malleable plastic while the applicator 102 is formed of a clear acrylic. Forming the two parts separately and then attaching them is one way to accomplish such a tip 100. Of course, a multi-material tip may also be formed as a unitary piece, e.g., in a single mold (such as by co-molding or over-molding), and such is also contemplated by this disclosure.

In addition, although the thermal member 112 and the tip 100 may be formed separately, in other implementations the manufacturing processes may overlap.

Although embodiments have been described in language specific to the structural features and/or methodological acts, it is to be understood that the claims are not necessarily limited to the specific features or acts described. Rather, the specific features and acts are disclosed as illustrative forms of implementing the embodiments.

What is claimed is:

1. A cosmetic applicator comprising:

an applicator tip having an application area having an applicator face having a recess formed therein;

an opening in the face through which a cosmetic product is dispensed, the opening spaced apart from the recess; and a thermal member capable of transferring heat to or from a user's skin disposed within the recess on the applicator face, wherein a depth of the recess is less than a thickness of the thermal member;

wherein the thermal member does not contact the opening.

2. The applicator of claim 1, wherein the thermal member comprises a plate disposed within the recess in the face of the applicator tip.

3. The applicator of claim 2, wherein the plate is a contiguous plate.

4. The applicator of claim 2, wherein the plate is adhered within the recess of the face of the applicator tip.

5. The applicator of claim 1, wherein the thermal member is retained in the recess using at least one of a press fit, an adhesive, or welding.

6. The applicator of claim 1, wherein the thermal member comprises a material different from the applicator tip.

7. The applicator of claim 1, wherein the thermal member comprises at least one of a metal, a stone material, or ceramic.

8. The applicator of claim 1, wherein the thermal member comprises at least one of stainless steel, aluminum, zinc, magnesium, tin, nickel, titanium, steel, copper, brass, platinum, gold, silver, and alloys.

9. The applicator of claim 1, wherein the thermal member comprises a stone material.

10. The applicator of claim 1, wherein the applicator tip comprises a body and a product delivery passageway is disposed through the body, terminating at the opening.

11. The applicator of claim 10, wherein the product delivery passageway is offset relative to a central axis of the applicator tip.

12. A dispenser comprising:

a housing having a reservoir for containing a product;

an applicator tip having a recess formed therein, the applicator tip coupled to the housing and having an application area having a product delivery passageway extending through the applicator tip and terminating at an applicator opening in the tip; and a thermal member capable of transferring heat to or from a user's skin disposed on the applicator tip, the thermal member disposed within the recess and spaced from the applicator opening, wherein a depth of the recess is less than a thickness of the thermal member;

wherein the thermal member does not contact the applicator opening.

13. The dispenser of claim 12, wherein the thermal member is a contiguous plate.

14. The dispenser of claim 13, wherein the plate has a substantially uniform thickness.

15. The dispenser of claim 12, wherein the thermal member has an application face for contacting a user.

16. The dispenser of claim 15, wherein the application face is at least one of convex, concave, or substantially planar.

17. The dispenser of claim 15, wherein the application face is textured.

18. A dispenser comprising:

a housing having a reservoir for containing a product;

an applicator tip coupled to the housing and having a substantially disc-shaped applicator area including a recess formed therein, and a product delivery passageway extending through the applicator tip and terminating at an opening in the applicator; and a plate-shaped thermal member storage mechanism capable of transferring heat to or from a user's skin disposed within the recess on the applicator providing a contiguous application surface for contacting a user, wherein a depth of the recess is less than a thickness of the thermal member;

wherein the thermal storage mechanism is spaced from the opening in the applicator and the thermal storage mechanism does not contact the opening in the applicator.

* * * * *